US007604437B2

(12) United States Patent
Wissmann et al.

(10) Patent No.: US 7,604,437 B2
(45) Date of Patent: Oct. 20, 2009

(54) METHOD AND APPARATUS FOR CREATING SUPPORT COLUMNS USING A HOLLOW MANDREL WITH UPWARD FLOW RESTRICTORS

(75) Inventors: Kord J. Wissmann, Mooresville, NC (US); Brian C. Metcalfe, Huntersville, NC (US)

(73) Assignee: Geopier Foundation Company, Inc., Moorseville, NC (US)

( * ) Notice: Subject to any disclaimer, the term of this patent is extended or adjusted under 35 U.S.C. 154(b) by 19 days.

(21) Appl. No.: 12/035,976

(22) Filed: Feb. 22, 2008

(65) Prior Publication Data

US 2008/0205993 A1 Aug. 28, 2008

Related U.S. Application Data

(60) Provisional application No. 60/902,504, filed on Feb. 22, 2007, provisional application No. 60/902,861, filed on Feb. 23, 2007.

(51) Int. Cl.
*E02D 3/12* (2006.01)

(52) U.S. Cl. ..... 405/240; 405/232

(58) Field of Classification Search ..... 405/267, 405/271, 231, 232, 236, 240, 249; 175/23, 175/424

See application file for complete search history.

(56) References Cited

U.S. PATENT DOCUMENTS

| | | | | |
|---|---|---|---|---|
| 5,249,892 | A * | 10/1993 | Fox et al. | 405/233 |
| 6,425,713 | B2 * | 7/2002 | Fox et al. | 405/243 |
| 6,505,998 | B1 * | 1/2003 | Bullivant | 405/271 |
| 6,773,208 | B2 | 8/2004 | DeWitt et al. | |
| 7,326,004 | B2 * | 2/2008 | Wissmann et al. | 405/245 |
| 7,488,139 | B2 * | 2/2009 | Wissmann | 405/271 |
| 2002/0009337 | A1 * | 1/2002 | Fox et al. | 405/232 |
| 2004/0115011 | A1 | 6/2004 | Fox | |
| 2004/0240945 | A1 | 12/2004 | Frantz | |
| 2006/0088388 | A1 * | 4/2006 | Wissmann et al. | 405/232 |
| 2007/0077128 | A1 * | 4/2007 | Wissmann | 405/232 |
| 2008/0031694 | A1 * | 2/2008 | Wissmann et al. | 405/232 |
| 2008/0159813 | A1 * | 7/2008 | Wissmann et al. | 405/232 |
| 2008/0193223 | A1 * | 8/2008 | Wissmann et al. | 405/229 |

OTHER PUBLICATIONS

PCT International Search Report and Written Opinion for PCT/US2008/054752 dated Jul. 9, 2008.

* cited by examiner

*Primary Examiner*—Frederick L Lagman
(74) *Attorney, Agent, or Firm*—Ward and Smith, P.A.

(57) ABSTRACT

A system and method for installing aggregate piers is provided. A cylindrical hollow mandrel is driven to a desired depth. Aggregate is fed through the mandrel in steps. The mandrel is raised and driven to tamp the aggregate. Physical members in a tamping head of the mandrel allow aggregate to remain in a cavity formed by the mandrel, and prevent aggregate from entering the mandrel during driving.

36 Claims, 9 Drawing Sheets

METHOD AND APPARATUS FOR CREATING SUPPORT COLUMNS USING A HOLLOW MANDREL WITH UPWARD FLOW RESTRICTORS

CROSS REFERENCE TO RELATED APPLICATIONS

This application is related to and claims priority to U.S. Provisional Application Ser. No. 60/902,504, filed Feb. 22, 2007 and U.S. Provisional Application Ser. No. 60/902,861 filed Feb. 23, 2007. The disclosures of both referenced Provisional Applications are specifically incorporated by reference herein.

FIELD OF THE INVENTION

The present invention relates to the installation of aggregate piers in foundation soils for the support of buildings, walls, industrial facilities, and transportation-related structures, using displacement mandrels. In particular, the present invention is directed to methods and apparatus for the installation of aggregate piers through the use of a cylindrical hollow mandrel that includes arrangements for restricting the upward flow of aggregate into the mandrel during compaction.

BACKGROUND OF THE INVENTION

Heavy or settlement-sensitive facilities that are located in areas containing soft or weak soils are often supported on deep foundations. Such deep foundations are typically made from driven pilings or concrete piers installed after drilling. The deep foundations are designed to transfer structural loads through the soft soils to a more competent soil strata.

In recent years, aggregate piers have been used increasingly to support structures located in areas containing layers of soft soils. The piers are designed to reinforce and strengthen the soft layers and minimize resulting settlements. Such piers are constructed using a variety of methods including drilling and tamping methods such as described in U.S. Pat. Nos. 5,249,892 and 6,354,766 ("Short Aggregate Piers"), driven mandrel methods such as described in U.S. Pat. No. 6,425,713 ("Lateral Displacement Pier"), and tamping head driven mandrel methods such as developed by Nathanial S. Fox and known as the "Impact Pier" and described in U.S. Pat. No. 7,226,246.

The "Short Aggregate Pier" technique referenced above, which includes drilling or excavating a cavity, is an effective foundation solution, especially when installed in cohesive soils where the sidewall stability of the hole is easily maintained.

The "Lateral Displacement Pier" and "Impact Pier" methods were developed for aggregate pier installations in granular soils where the sidewall stability of the cavity is not easily maintained. The "Lateral Displacement Pier" is built by driving a pipe into the ground, drilling out the soil inside the pipe, filling the pipe with aggregate, and using the pipe to compact the aggregate "in thin lifts." A beveled edge is typically used at the bottom of the pipe for compaction.

The "Impact Pier" is an extension of the "Lateral Displacement Pier." In this case, a smaller diameter (8 to 16 inches) tamper head is driven into the ground. The tamper head is attached to a pipe, which is filled with crushed stone once the tamper head is driven to the design depth. The tamper head is then lifted, thereby allowing stone to remain in the cavity, and then the tamper head is driven back down in order to densify each lift of aggregate. An advantage of the Impact Pier, over the Lateral Displacement Pier, is the speed of construction.

The invention is an improvement on such prior art techniques, and in particular, the Lateral Displacement Pier, Impact Pier and their methods. A more efficient mechanism is provided for compacting aggregate by restricting upward movement of the aggregate through the mandrel during driving of the mandrel.

Generally, the invention employs a steel mandrel made up of an upper pipe as a primary portion used for the delivery of aggregate to a lower pipe portion or tamper head. During extraction of the mandrel, upward movement of aggregate is minimized. However, during compaction there is a possibility that materials may be pushed up into the mandrel as the mandrel is forced down. In accordance with the invention, the possibility of materials moving up into the mandrel is eliminated or substantially reduced.

SUMMARY OF THE INVENTION

In one aspect, the invention relates to a mandrel equipped with a flow restrictor to avoid aggregate moving up into the mandrel during downward compaction. The invention is related to systems and methods such as described in U.S. Pat. No. 6,425,713 ("Lateral Displacement Pier") and the tamper head driven mandrel method such as developed by Fox and known as the "Impact Pier" and disclosed in U.S. Pat. No. 7,226,246. The disclosures of all said aforementioned documents are expressly incorporated herein by reference.

In one embodiment, the invention can employ two cylindrical pipe portions aligned with their adjacent ends interconnected to form an elongate mandrel. A top pipe portion of the mandrel is a primary aggregate delivery mechanism. Aggregate is fed into a hopper at the upper end of the top pipe portion. A bottom pipe portion of the mandrel can have a slightly larger diameter than the top pipe portion also operates as a tamper head for the mandrel. Structural members, which can be active mechanical or passive, are located within the bottom pipe portion. The structural members allow generally unrestricted movement of aggregate materials downward through the mandrel and out through the bottom pipe portion as the mandrel is lifted. When tamping of aggregate is conducted through the downward movement of the mandrel, the structural members restrict or retard the upward flow of aggregate or other materials into the mandrel.

In a first embodiment, the bottom pipe portion includes mechanical flow restrictors, for example, in the form of movable vertically extending members. The restrictors are mounted near the top region on the interior of the bottom pipe portion, adjacent to the interface of the two pipe sections (although it is understood that the top and bottom portions could comprise a single unitary unit with varying wall thicknesses, etc.). The mechanical flow restrictors operate in an active and dynamic manner to restrict upward movement of aggregate or soil in the mandrel during tamping or compacting operations.

In this embodiment, the mechanical flow restrictors are preferably made up of steel chains, wire rope, or other like mechanisms. The mechanical flow restrictors are typically secured at their top end inside the mandrel bottom pipe portion or tamper head, and extend vertically downward within the mandrel bottom pipe portion as the mandrel is raised. This is because the aggregate straightens out the restrictors as the mandrel is lifted upward. When the mandrel is moved downward during aggregate compaction, the mechanical flow restrictors are free to move, and move inward and upward within the mandrel bottom pipe portion as a result of interaction with aggregate. When the restrictors move inward, they tend to bunch up the aggregate thus restricting upward flow of aggregate in the mandrel.

In a more specific embodiment, the lower end of the mandrel may also include a sacrificial plate (otherwise also referred to herein as a disposable driving shoe). The sacrificial plate is inserted into an opening at the bottom of the tamper head of the mandrel. The plate prevents soil from entering the mandrel during the driving operation and is left at the bottom of the mandrel during aggregate placement and compaction. Alternatively, the sacrificial plate may be eliminated and aggregate may be placed inside of the mandrel prior to driving. The aggregate serves to restrict soil from entering the mandrel during driving, as it is prevented from flowing back into the mandrel by the mechanical flow restrictors.

In constructing an aggregate pier according to the present invention, the mandrel is driven to its design depth. If a sacrificial plate is employed, the aggregate can be delivered to the top of the mandrel through the hopper that is mounted to the upper end of the mandrel. If the mandrel is driven without a sacrificial plate, aggregate can be fed into the mandrel prior to driving. Upon achieving the desired depth during the driving operation, the mandrel is then partially extracted a predetermined amount, e.g., typically about 3 feet, and the aggregate is permitted to flow through the primary mandrel delivery top portion and the larger bottom pipe portion. The mandrel is then driven downward, typically about 2 feet, using conventional equipment capable of delivering static or dynamic downward force to the bottom pipe portion of tamper head. During downward driving, the mechanical flow restrictors are pushed inward and upward by the aggregate entering into the bottom of the mandrel. This action causes the flow restrictors to bunch together in the tamper head. The tamper head is then closed off in this region by the flow restrictors and the upward flow of aggregate in the mandrel thereby avoided or retarded.

In an alternative embodiment, the invention is as described previously, and also has two cylindrical pipe portions aligned with their adjacent ends interconnected to form an elongated mandrel. As before, the top pipe portion of the mandrel is the primary aggregate delivery mechanism, and aggregate is fed into a hopper at the upper end of the top pipe portion. The bottom pipe portion of the mandrel has, in one embodiment, a slightly larger diameter than the top pipe portion, and permits unrestricted movement of the aggregate through the mandrel when raising the mandrel. The bottom pipe portion again serves as a tamper head for the mandrel.

In this embodiment, passive flow restrictors are mounted on the inside of the bottom pipe portion, and serve to restrict upward movement of aggregate during a tamping or compacting operation. The passive flow restrictors are static structures and extend generally horizontally inward. The passive flow restrictors may be made of steel, steel alloys, wood, metal plates, or other construction materials capable of providing passive resistance inside the mandrel bottom portion upon application of direct vertical downward movement of the mandrel. The passive flow restrictors are fixed along the interior periphery of the bottom pipe portion or tamper head. The angle of the passive flow restrictors along their top face may vary from about 0 degrees relative to the horizontal, to about 60 degrees downward from horizontal. They extend into the center of the mandrel an amount sufficient to restrict upward movement of aggregate during tamping, but without substantially impeding downward movement of the aggregate relative to the mandrel with the mandrel is raised.

As with the first embodiment, the lower end of the mandrel may also be fitted with a sacrificial plate inserted into the opening at the bottom of the tamper head of the mandrel. In an alternative, the plate may be eliminated and aggregate placed in the mandrel prior to driving to prevent soil from entering during operation. During downward driving, aggregate entering the bottom of the mandrel is engaged by the passive restrictors. This action causes the aggregate between the passive restrictors to "arch" to the restrictors, thus "clogging" the mandrel and preventing upward flow of the aggregate.

The present invention in all embodiments permits unrestricted gravity flow or movement of the aggregate relative to the mandrel while raising the mandrel and provides for a mechanical or passive constriction that creates a temporary aggregate plug while driving the mandrel downward. The aggregate plug prevents further upward movement of the aggregate within the mandrel and thus allows the aggregate plug to be used as an additional compaction surface, along with the bottom edge of the tamper head, during downward ramming. This greater compaction surface facilitates the construction of stronger and stiffer piers.

It is to be understood that the invention as described hereafter is not limited to the details of construction and arrangements of components set forth in the following description or illustrations in the Drawings. The invention is capable of alternative embodiments and of being practiced or carried out in various ways. Specifically, the dimensions as described, and where they appear on the Drawings are exemplary embodiments only and may be modified by those skilled in the art as conditions warrant.

DETAILED DESCRIPTION

In one aspect, a method and apparatus is provided for the installation of aggregate piers in foundation soils. The method consists of driving a hollow pipe mandrel 1 as shown in the Figures into the foundation soils with a base machine capable of driving the mandrel. The base machine is typically equipped with a vibratory piling hammer and the ability to apply a static force to the mandrel to achieve penetration into a foundation soil. Such machines are conventional and well known in the art, and need not be described in greater detail herein. Alternative machines, such as those that apply dynamic force only, static force only, or a combination thereof may also be used.

Figure 13:
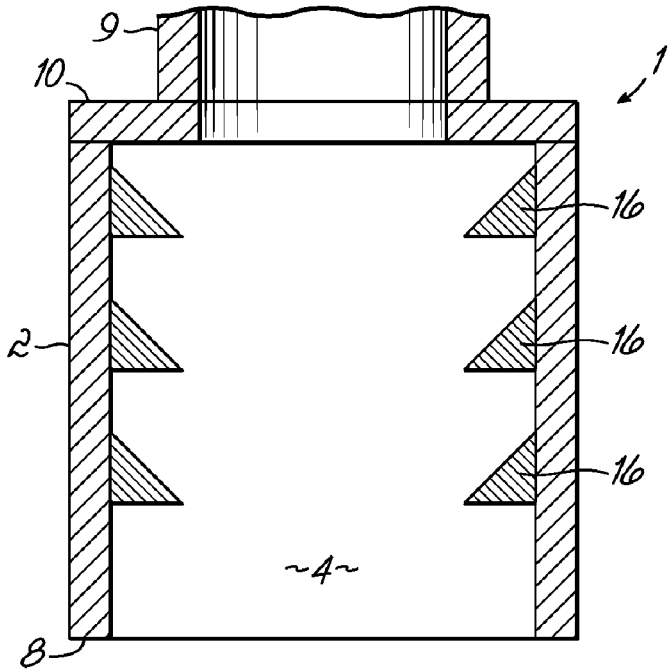
FIG. 13 is an enlarged partial cross-section schematic front view of the bottom pipe portion or tamper head of the mandrel of FIG. 11 with the passive flow restrictors.
Figure 14:
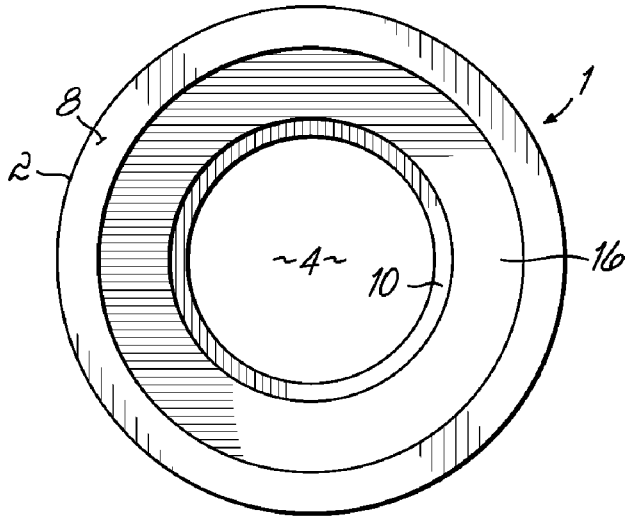
FIG. 14 is an enlarged bottom view of the bottom pipe portion or tamper head shown in FIG. 13 showing the restrictors extending around the inner periphery of the bottom pipe portion
Figure 15:
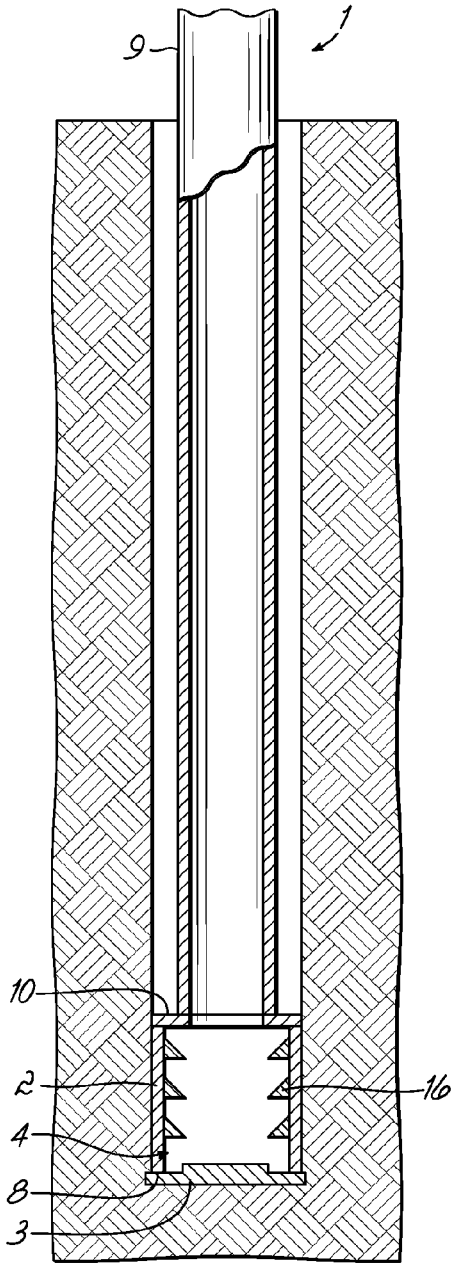
FIG. 15 is a front partial cross-section schematic view of the mandrel of FIG. 11 as the mandrel is being driven with a sacrificial end cap.
Figure 16:
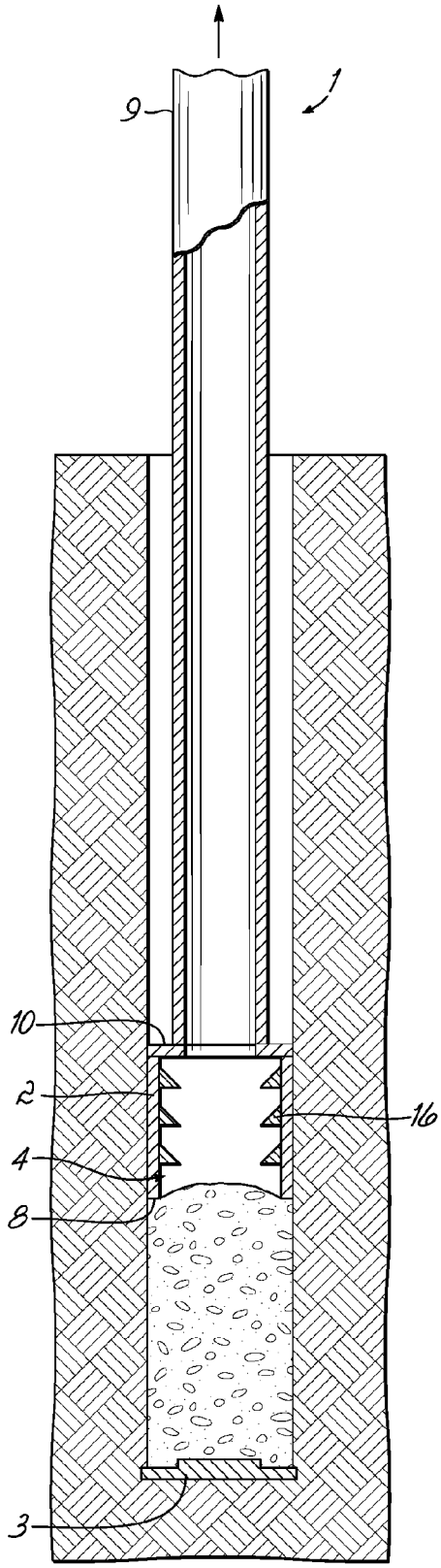
FIG. 16 is a front partial cross-section schematic view of the mandrel, similar to FIG. 15, as the mandrel is being extracted leaving the sacrificial end cap at the bottom of the cavity and leaving a loose fill of aggregate in the cavity.

In a preferred embodiment, as shown in FIGS. 1, 2, 7, 8, 9, 11, 12, 13, 15, 16 and 17, the mandrel can have a smaller diameter top pipe portion 9 mounted on top of a larger diameter bottom pipe portion 2. Although the upper portion 9 and lower portion 2 of the mandrel 1 are shown in an exemplary manner as separate parts with the lower portion 2 of greater outer diameter than the upper portion 9, they can take other forms. For instance, the upper portion 9 and lower portion 2 can be made as a single integral one piece unit. Further, the outer diameter of the upper portion 9 can be the same as that of the lower portion 2. In such an embodiment the flow restrictors can be accommodated by making the wall of the lower portion 2 thinner relative to the upper portion 9. In an exemplary embodiment, the top and bottom pipe portions 9 and 2 are preferably formed of standard cylindrical or articulated steel pipe having desired size dimensions for the aggregate pier to be constructed as will be apparent to those of ordinary skill. The lower end of the top pipe portion 9 is affixed to the upper end of the bottom pipe portion 2 preferably using a ring-shaped connector plate 10 and a suitable weld or the like, as shown in FIGS. 4 and 13. The bottom pipe portion 2 serves as a tamping head. In the embodiment of FIGS. 1-10, the bottom pipe portion 2 is equipped with vertically extending flow restrictors 6 that restrict the upward movement of aggregate through the mandrel during compaction.

Prior to driving, the mandrel is optionally fitted with a sacrificial plate 3 which serves as a driving shoe and fits into an inside annulus 4 of the bottom portion 2 making up the mandrel head. The disposable driving shoe is slightly larger than the annulus of the mandrel head and thus remains in position at the bottom of the mandrel 1 during driving to a required driving depth. When the mandrel 1 is raised, the driving shoe remains at the driven depth and is sacrificed as part of the operation. The sacrificial plate 3, which constitutes the driving shoe, may be fabricated from steel, steel alloy, wood, metal plates, or other construction materials. Alternatively, in place of the plate 3, the mandrel 1 may be filled with aggregate such that when the mandrel 1 is driven, the aggregate will form a temporary plug inside the annular space 4.

Figure 1:
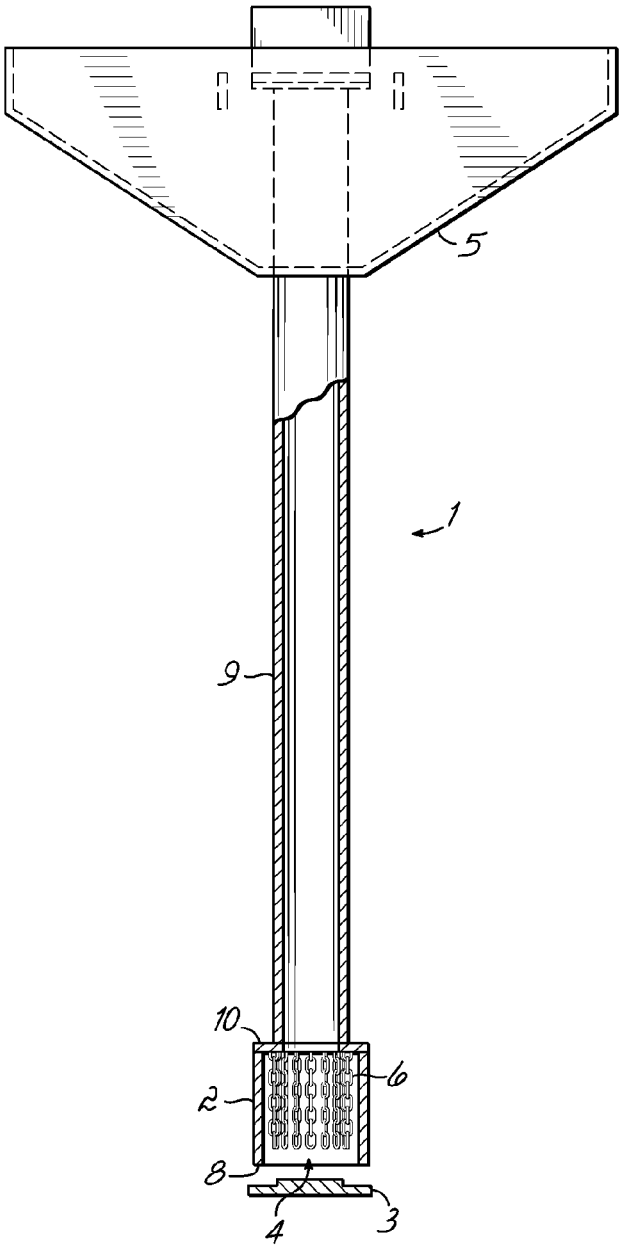
FIG. 1 is a front partial cross-section schematic view of a first embodiment illustrating a mechanically restricted mandrel in accordance with the present invention.
Figure 2:
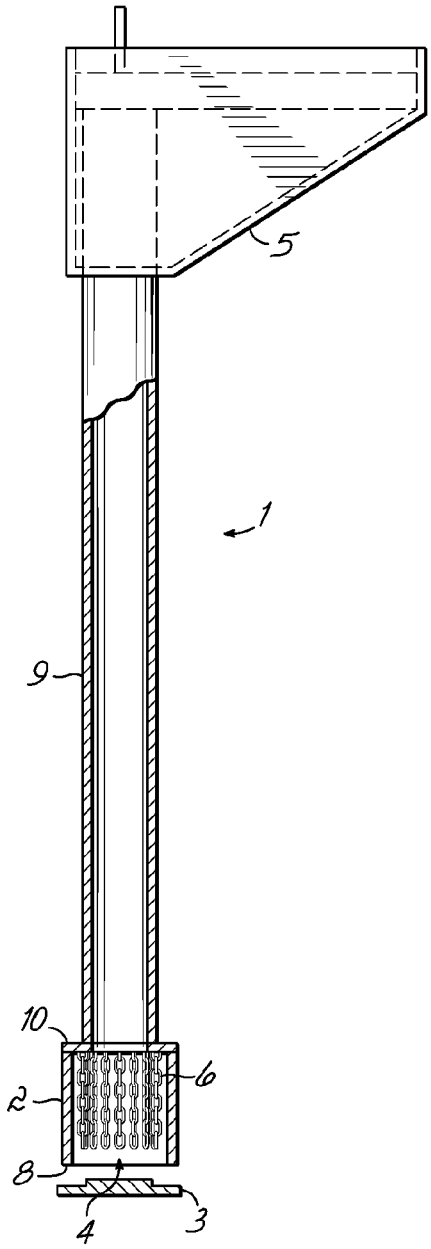
FIG. 2 is a side partial cross-section schematic view of the mandrel of FIG. 1.
Figure 3:
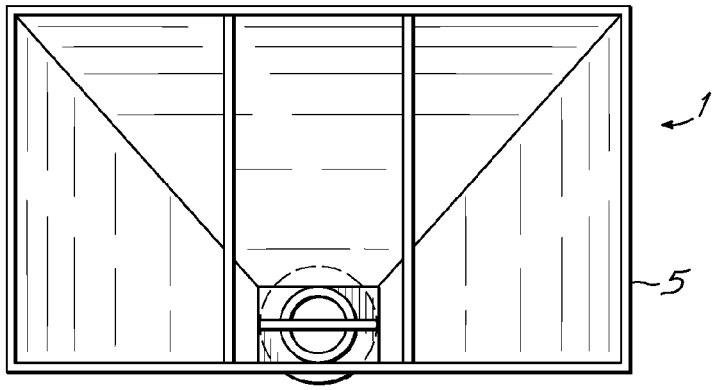
FIG. 3 is a top view of the mandrel of the invention showing a hopper for aggregate.
Figure 4:
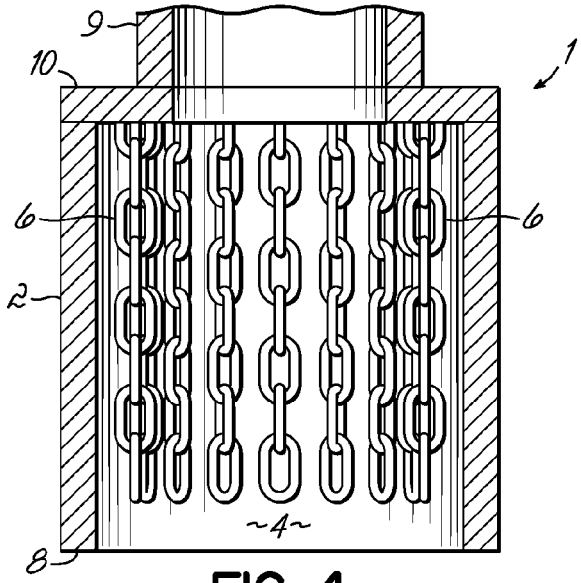
FIG. 4 is an enlarged partial cross-section schematic view of the bottom pipe portion or tamper head of the mandrel of FIG. 1, showing an embodiment of mechanical flow restrictors, for example chains, arranged around the inside periphery of the tamper head.

A hopper 5 is shown throughout the Figures, in particular FIG. 3, and can be fixed (or removably affixed) to the top of the mandrel. The hopper 5 is used to feed aggregate into the mandrel at any time during the operation (such as, for example, through a slotted mandrel as described in International Patent Application No. PCT/US2006/019678, the disclosure of which is incorporated herein by reference).

With respect to the aggregate used with the invention, it is typically "clean" stone with maximum particle size of typically less than 2 inches. By the term "clean stone" it is meant that it typically contains less than 5% passing the No. 200 sieve size (0.074 inches). Alternative aggregate compositions may also be used such as clean stone having maximum particle sizes ranging between ¼-inch and 3 inches, aggregate with more than 5% passing the No. 200 sieve size, recycled concrete, slag, recycled asphalt, sand, glass, and other construction materials.

The top portion 9 of the mandrel 1 may in an alternative construction be manufactured using rolled steel to form a cylinder having a circular cross-section. The bottom portion 2 of the mandrel 1 preferably has a cross-sectional area that is slightly greater than the cross-sectional area of the upper portion of the mandrel. Other alternative mandrel dimensions and shapes may also be used such as mandrels made from steel to form a square, octagonal, or an articulated shape.

The lower edge 8 of the bottom portion 2 of the mandrel 1 making up the tamping head may also be beveled outwardly, instead of straight across as shown in the exemplary embodiment.

The outside diameter of the top portion 9 of the mandrel 1 is preferably about 10 inches although the diameter of the top portion may vary (such as, for example, from about 6 inches to about 14 inches). The mandrel wall thickness may also vary, for example, from about ¼-inch to about one inch, depending on the mandrel diameter, length, mandrel construction materials, and driving conditions. The mandrel 1 is preferably about 10 to about 40 feet long. However, alternate lengths, for example, as short as 5 feet and as long as 70 feet may be used. The outside diameter of the bottom or lower pipe portion 2 is preferably about 2-6 inches greater than the outside diameter of the upper pipe portion 9, depending on the diameter of the upper pipe portion.

Figure 5:
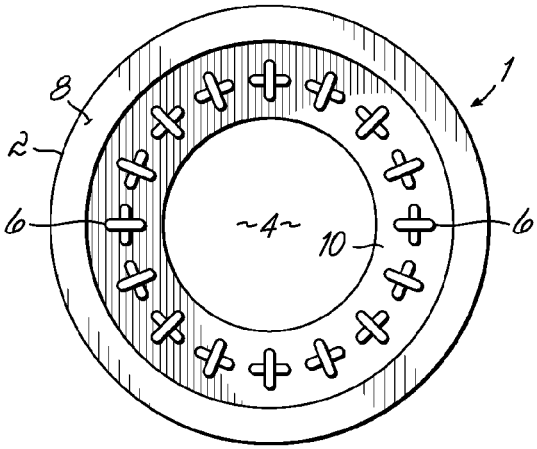
FIG. 5 is an enlarged plan bottom view of the bottom pipe portion or tamper head shown in FIG. 1.
Figure 6:
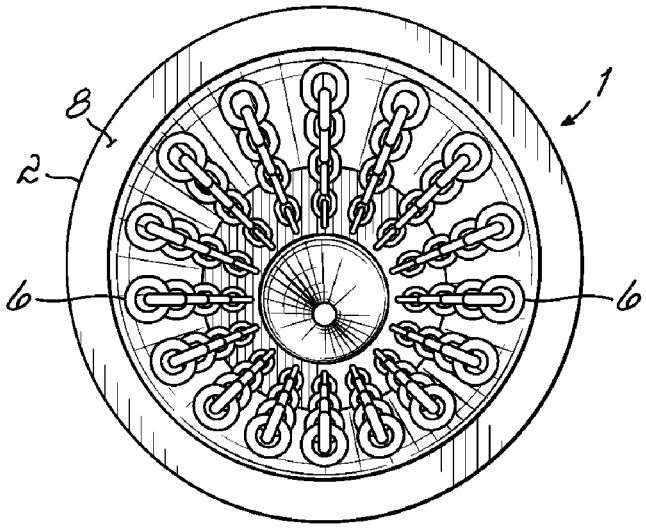
FIG. 6 is a perspective view of the interior of the bottom portion of the embodiment of FIG. 1.
Figure 10:
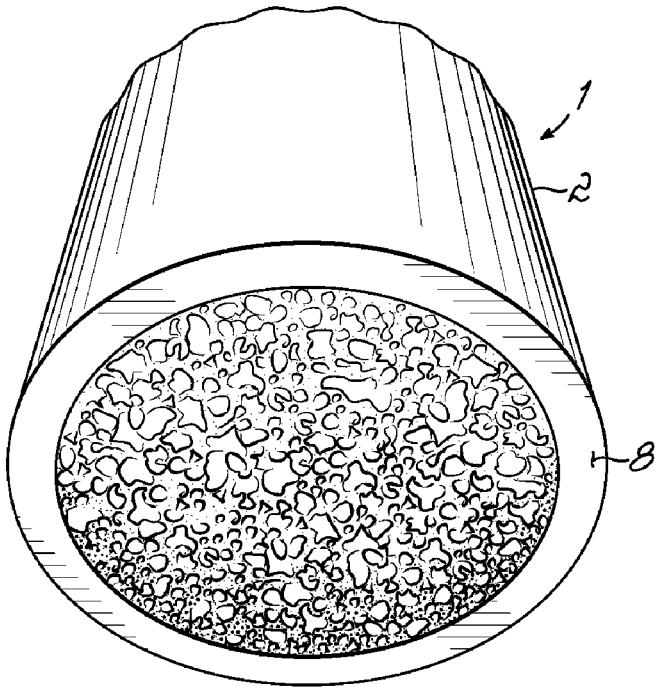
FIG. 10 is a view demonstrating arching of aggregate inside of the bottom portion of the mandrel to block upward flow during tamping.
Figure 7:
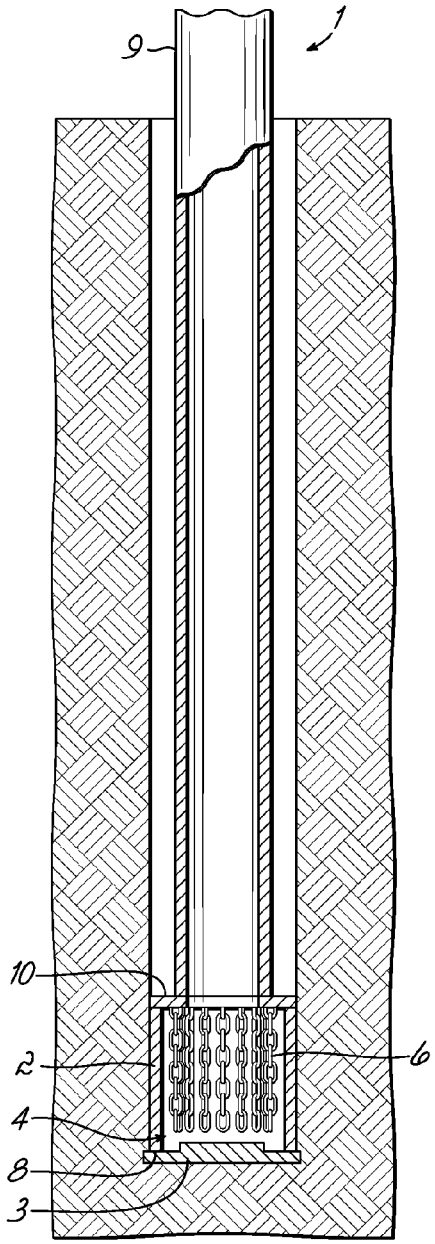
FIG. 7 is a front partial cross-section schematic view of the mandrel of FIG. 1, as the mandrel is being driven with a sacrificial end cap.
Figure 8:
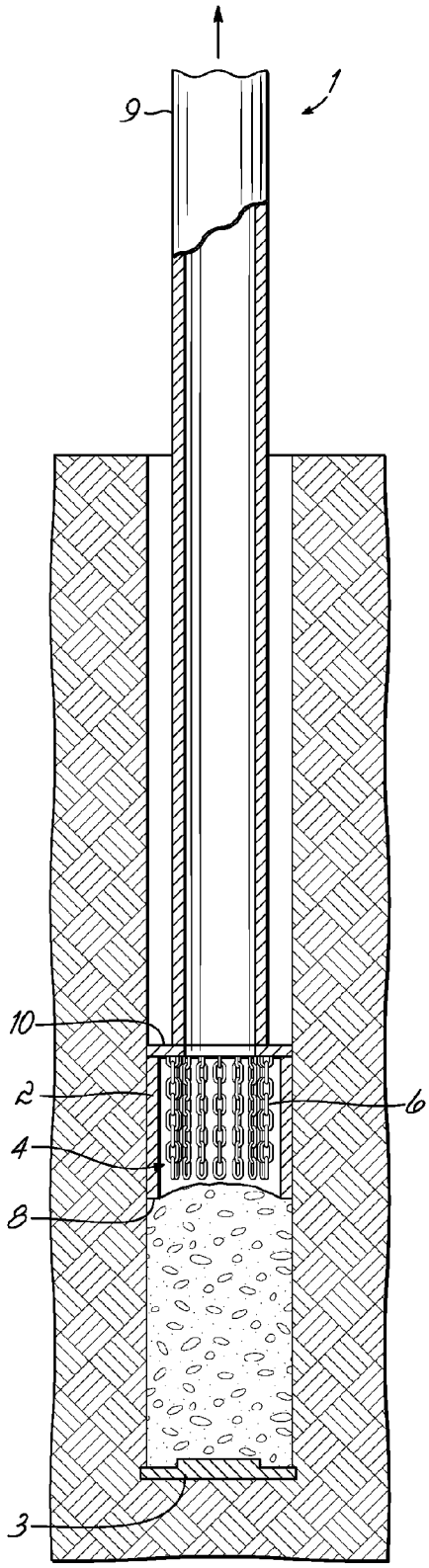
FIG. 8 is a front partial cross-section schematic view of the mandrel, similar to FIG. 7, as the mandrel is being extracted leaving the sacrificial end cap at the bottom of the cavity, and leaving a loose fill of aggregate in the cavity.
Figure 9:
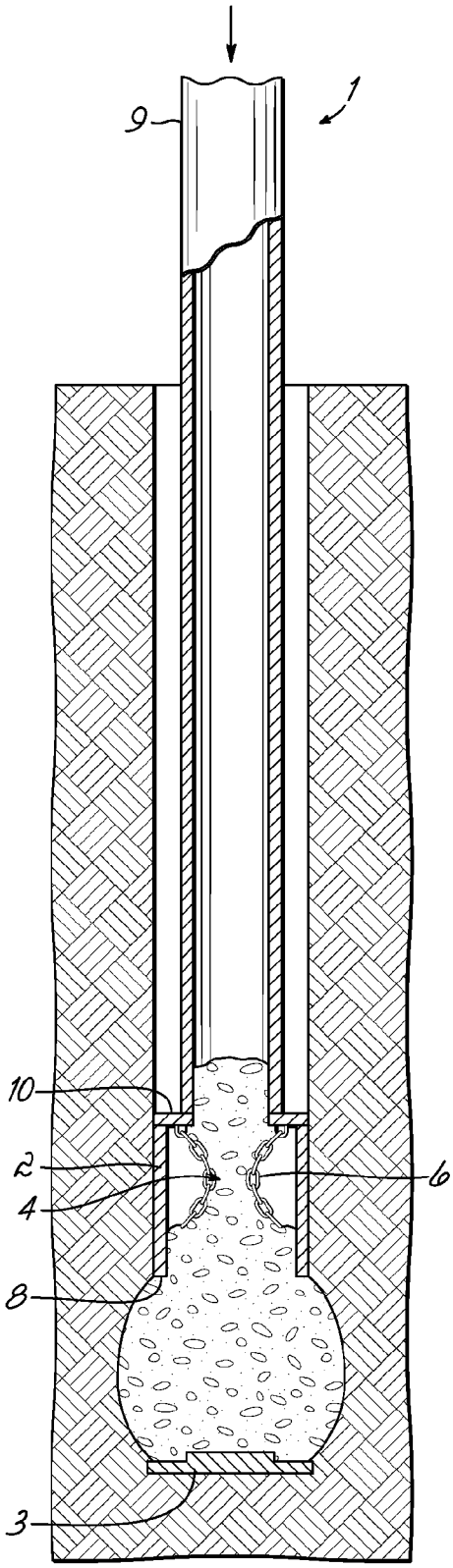
FIG. 9 is a front partial cross-section schematic view of the mandrel, similar to FIGS. 7 and 8, as the mandrel is being driven downward to compact the loose aggregate below the bottom of the mandrel, with the flow restrictors deforming upwardly and inwardly to constrict the cross-sectional area of the tamper head, and preventing the upward movement of the aggregate through the mandrel by forming a temporary aggregate plug in the bottom portion of the mandrel.
Figure 17:
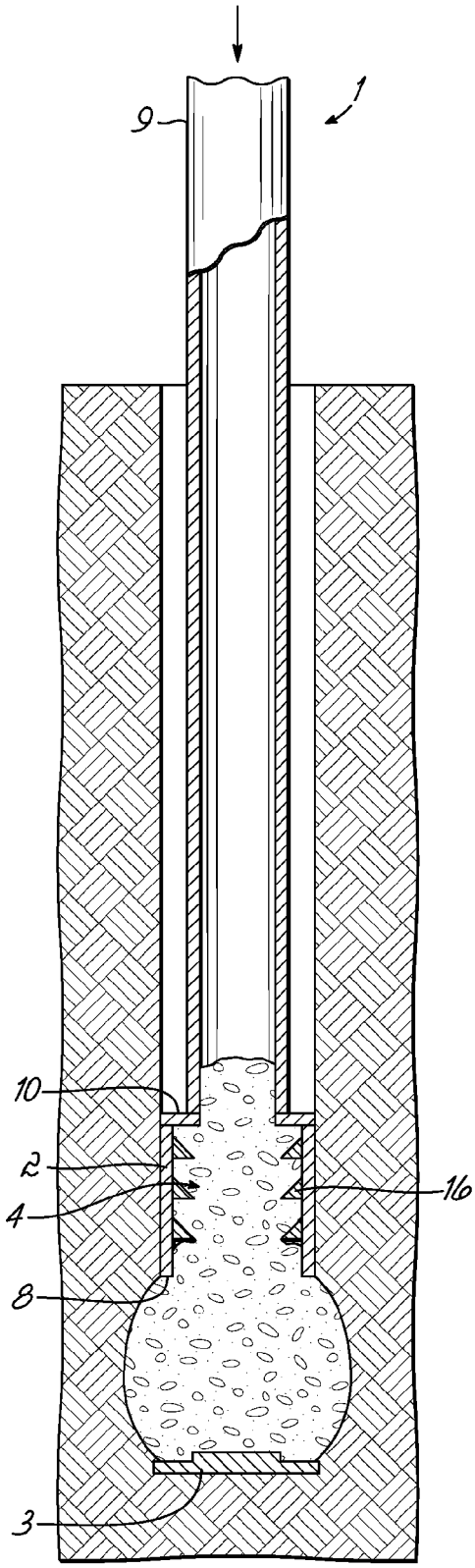
FIG. 17 is a front view of the mandrel, similar to FIGS. 15 and 16, as the mandrel is being driven downward to compact a loose fill of aggregate, with the aggregate engaging with the passive flow restrictors.
Figure 11:
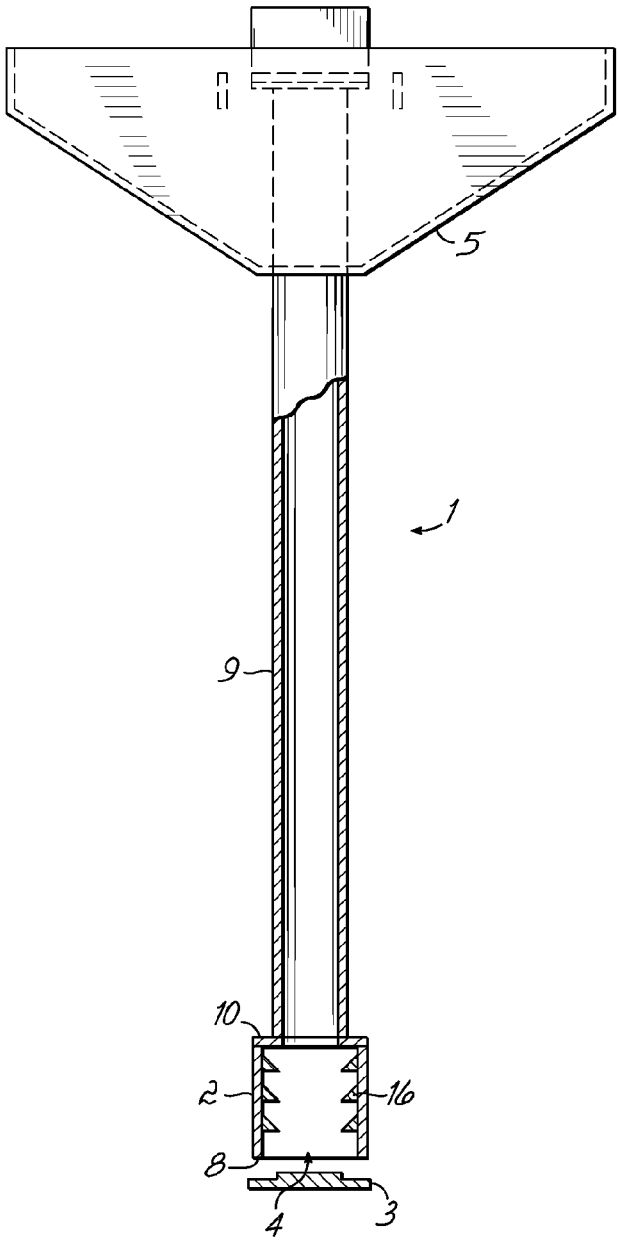
FIG. 11 is a front partial cross-section schematic view of a second embodiment illustrating passive flow restrictors in accordance with the present invention.
Figure 12:
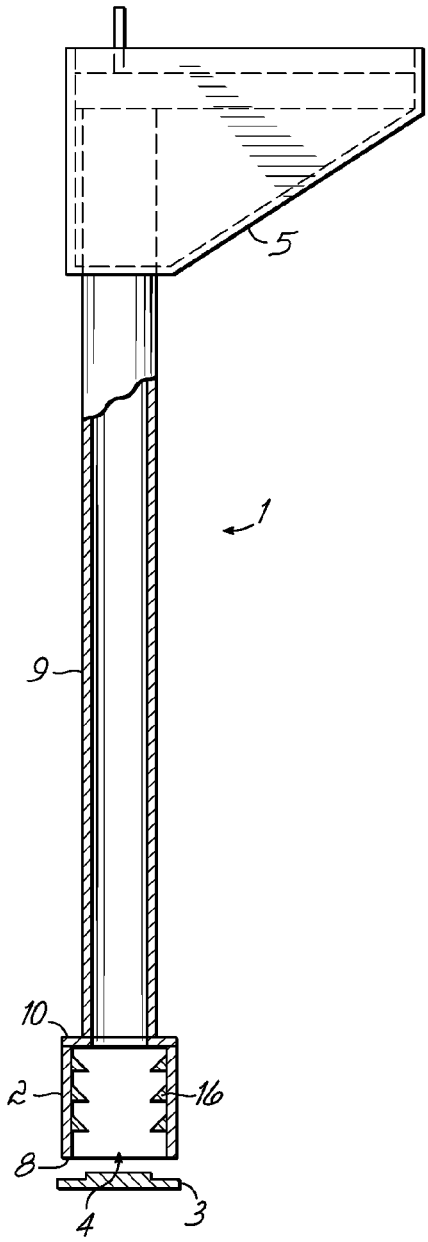
FIG. 12 is a side partial cross-section schematic view of the mandrel shown in FIG. 11.

The bottom portion 2 of the mandrel 1 in the embodiment of FIGS. 1-10 contains vertically extending moveable mechanical flow restrictors 6 affixed at their top ends to the undersurface of a connector plate 10 adjacent the opening at the bottom of top pipe portion 9 as shown in FIGS. 4 and 5. The flow restrictors 6 hang freely along the inside periphery of the bottom pipe portion 2 making up a tamper head, in a generally circular pattern as also shown in FIG. 6.

In this embodiment, the flow restrictors 6 are preferably sixteen steel linked chains which form a circular array in the tamper head 2 of the mandrel 1. Depending on the diameter of the mandrel 1 and the tamper head, an alternate number of steel link chains may be used in the array. The number of links on each steel chain can also vary depending upon the size of each individual chain link and the height of the tamper head 2. The total length of each individual chain is preferably about ⅓ to about ⅔ of the inside height of the lower pipe portion 2. The thickness of each chain length varies, for example, from about ¼" to about 1". Alternative materials, such as wire rope or other mechanisms that resist tensile forces, but exhibit little resistance to compressive forces, may also be used for the upward flow restrictors 6.

In operation, the mandrel 1 is driven to the desired design depth. If the sacrificial plate 3 is used, the hopper 5 is filled with aggregate after driving to the desired design depth. Alternatively, the aggregate is partially or fully filled inside the mandrel head 2 prior to driving so that constriction of the mechanical flow restrictors 6 forms a temporary aggregate plug in the bottom portion 2 making up the tamper head of the mandrel 1 so that soil does not appreciably enter the inside of the mandrel 1 and 2 during driving to a desired design depth.

Once the mandrel 1 reaches the design depth, it is then raised slightly, and the sacrificial plate 3, or the temporary aggregate plug when no plate is used, becomes dislodged and remains at the design depth. As the mandrel is raised, the aggregate remains in place by moving downward relative to the mandrel and out of the annular space 4 in the tamper head 2. As a result, the mandrel is raised but the aggregate remains in place, with no appreciable additional downward flow of aggregate. At this time, typically, the aggregate first contacts the side wall of the created cavity. During this operation, the mandrel 1 is raised, typically about 3 feet, and then driven back down, typically about 2 feet, to compact the aggregate that remained as a result of raising of the tamper head. The driving of the mandrel 1 forces the mechanical flow restrictors 6 to constrict upward due to engaging the aggregate, thereby reducing the cross-sectional area of the tamper head 2. In this manner, the aggregate is prevented from flowing in any significant amount back up into the mandrel 1. The restriction forms a temporary aggregate plug in the tamper head as is illustratively shown in FIG. 10.

In the context of the driving operation, alternative raising and driving amounts may be used. For example, to achieve a wider aggregate pier, the mandrel 1 may be raised 4 or 5 feet and then driven down 3 or 4 feet providing for a greater volume of compacted aggregate and a greater width of aggregate at a given depth. For applications where small widths are desired, the mandrel may be raised 2 feet and driven 1 foot. Other amounts can be used depending on the desired result as will readily be apparent to those of ordinary skill.

The temporary aggregate plug in the annular space 4 of the mandrel head made up of the bottom portion 2 facilitates forcing the loose lift of placed aggregate downward and laterally into the sidewalls of the hole and increases the pressure in the surrounding soils. As will be readily apparent, the pier is built incrementally in a bottom to top operation.

In an alternative embodiment as shown in FIGS. 11-17, the bottom portion 2 of the mandrel contains, for example, horizontally aligned passive flow restrictors 16 affixed about the periphery of the bottom portion 2. In the views of FIGS. 11, 12, 13, 15, 16 and 17, the flow restrictors 16 are shown only in part at the side edges of the inner periphery of bottom portion 2. In actual construction, the flow restrictors 16 typically extend around the inner periphery of the bottom portion 2 as more clearly shown in FIG. 14.

The passive flow restrictors 16 preferably have a downwardly sloping upper surface to facilitate downward flow of aggregate and a horizontal or reverse sloping (not shown) lower surface to restrict or prevent aggregate from flowing upwardly when the mandrel 1 moves downwardly during compaction. The passive flow restrictors 16 extend inwardly along the periphery of the bottom portion 2.

As an example, in the present embodiment, three horizontal passive flow restrictors at different heights are shown in the bottom portion 2 and extend all the way around the interior circumference. The spacing between the passive flow restrictors 16 may vary, for example, from 0.25 to 1 foot. The width of the passive flow restrictors 16 may vary depending on the inside diameter of the top portion 9 and bottom portion 2 of the mandrel, and on the particle sizes of the aggregate used. The width of the passive flow restrictors 16 is such that the aggregate is allowed to stay in the formed cavity (and contacting the cavity wall) by the raising movement of the mandrel. In contrast, passive restriction of upward flow of aggregate is achieved during driving of the mandrel 1 as a result of engagement between aggregate and restrictors 16. The number of passive flow restrictors 16 will vary depending on the length of the bottom portion 2. Further, as previously noted, the flow restrictors 16 will extend into the center of the bottom portion 2 an amount sufficient to restrict upward flow of aggregate during tamping, but without substantially preventing the aggregate from remaining at the bottom of the cavity upon raising of the mandrel 1.

In all other aspects, the embodiment of FIGS. 11-17 is otherwise typically the same as the embodiment of FIGS. 1-10.

In the operation of the embodiment of FIGS. 11-17, as before, the mandrel 1 is driven to the design depth. If the sacrificial plate 3 is used, the hopper 5 is again also filled with aggregate after driving to the design depth. Alternatively, as in the case of the embodiment of FIGS. 1-10, the aggregate may be partially or fully filled inside the mandrel 1 and bottom tamper head 2 prior to driving and the aggregate is engaged by the passive flow restrictors 16 to form a temporary aggregate plug in the bottom portion 2 of the mandrel 1 so that soil does not enter the inside of the mandrel 1 during driving.

Once the mandrel 1 reaches the design depth and the mandrel 1 is raised slightly, the sacrificial plate 3 or the temporary aggregate plug become dislodged and remains at the design depth. As the mandrel 1 is raised, the aggregate remains in place and moves downward relative to the mandrel and flows out of the annular space 4 in the lower portion 2 tamper head. In all other aspects, the method is typically as described with reference to FIGS. 1-10.

In implementing the invention, it is noted that full scale installation and field modulus load test were performed using the embodiment of FIGS. 1-10 as compared to a system such as is described in U.S. Pat. No. 7,226,246. In discussing the tests conducted, reference is made to FIG. 18 which is a graph illustrating the results of a modulus load test comparison between a device such as that illustrated in FIGS. 1-10 as compared to a device such as that disclosed in U.S. Pat. No. 7,226,246.

Example

Figure 18:
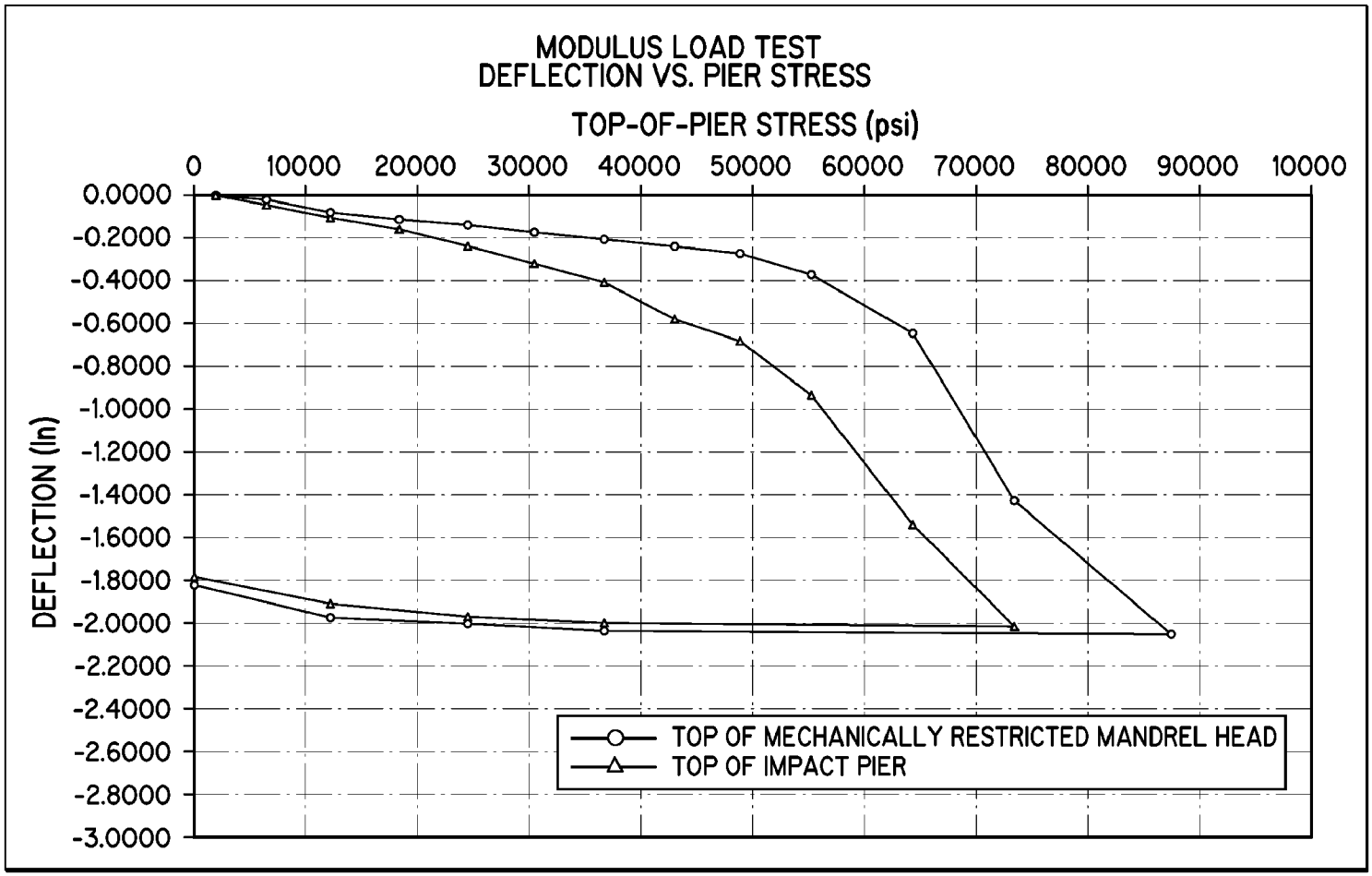
FIG. 18 is a graph illustrating a modulus load test comparison.

FIG. 18 shows test results for two piers, one constructed using a method similar to that described in U.S. Pat. No. 7,226,246 and one constructed using the invention. Both piers were built using mandrels with 14 inch diameter heads and using the 3 foot up and 2 foot down method (as described hereinabove). The graph of FIG. 18 shows that the pier constructed with a mandrel such as that of FIGS. 1-10 is stiffer than one constructed using a system such as that of U.S. Pat. No. 7,226,246. More particularly, the graph shows top-of-pier stress on the x-axis with top-of-pier deflection on the y-axis. Volume measurements made during construction showed that the average pier diameter using the system in accordance with the invention was 20% greater than that using the system of the referenced U.S. Patent.

In conducting the tests, the aggregate used for both systems for the modulus load test pier consisted of crushed limestone gravel having a nominal particle size ranging from about 0.50 to about 1.25 inches. The graph of FIG. 18 shows a side by side comparison where two piers were installed to a depth of 17 to 19 feet below the ground surface. The ground surface consisted of fine to medium grained particle sand with little or no silt.

Modulus load tests were prepared by placing a concrete cap over the top of the piers. The concrete cap was installed such that a bottom of the cap was formed 24 inches below ground surface and the top of the cap was appropriately level with ground surface. The cap was 24 inches in diameter such that the entire surface area of the top of the piers were confined. The tests were performed by applying incremental loads to the top of the concrete caps. A hydraulic ram and load reaction frame was used to apply the loads.

The table of FIG. 18 shows the stress at the top pier with the deflection of the top of the pier. The stress is determined by dividing the test load at each load increment by the area of the concrete cap. The deflection of the top of the pier was determined using dial gauges on the top of the concrete cap. The dial gauges were calibrated to have an accuracy of 0.001 inches. The dial gauges were mounted to referenced beams that were independently supported from the reaction frame.

As may be appreciated from a review of the table of FIG. 18, the test results indicated that for piers installed to similar depths and similar soil conditions using similar aggregate compositions, the system in accordance with the invention as illustrated in FIGS. 1-10 demonstrated higher stiffness when compared to piers installed using the system of the aforementioned patent. This comparison was done with stiffness defined as the stress on the top of the pier divided by the deflection of the top of the pier at the corresponding top of pier stress.

While the present invention has been illustrated by a description of various embodiments and while these embodiments have been described in considerable detail, it is not the intention of the Applicants' to restrict, or any way limit the scope of the appended claims to such detail. The invention in its broader aspects is therefore not limited to the specific details, representative apparatus and method, and illustrative example shown and described. Accordingly, departures may be made from such details without departing from the spirit or scope of Applicants' general inventive concept.

What is claimed is:

1. A system for constructing aggregate piers, comprising:

a mandrel having an upper portion and a tamper head, and a passage extending therethrough for feeding aggregate through the mandrel to the tamper head; and said tamper head being open to provide a passage for aggregate to pass through the tamper head out of the mandrel, and having a plurality of structural members connected therein for allowing substantially unimpeded free flow of aggregate therethrough when the mandrel is raised during operation, and for preventing aggregate flow back into the mandrel during downward tamping.

2. The system of claim 1, wherein the tamper head is larger in diameter than the upper portion of the mandrel.

3. The system of claim 1, further comprising a driving plate engageable with the tamper head to prevent soil from entering the mandrel during driving thereof to a predetermined depth.

4. The system of claim 1, wherein said structural members comprise moveable mechanical flow restrictors which move to block the tamper head passage into the mandrel preventing aggregate from flowing into the mandrel during tamping.

5. The system of claim 4, wherein said mechanical flow restrictors comprise chains attached to extend downward around an inner wall of the tamper head.

6. The system of claim 4, further comprising a driving plate engageable with the tamper head to prevent soil from entering the mandrel during driving thereof to a predetermined depth.

7. The system of claim 1, wherein said structural members comprise immobile passive flow restrictors which impede flow of aggregate back into the mandrel during tamping.

8. The system of claim 7, wherein said immobile passive flow restrictors are substantially horizontally extending members fixed around an inner wall of the tamper head around an interior periphery thereof.

9. The system of claim 8, wherein said substantially horizontally extending members have a top surface inclined from about 0 degrees relative to the horizontal to about 60 degrees downward from the horizontal.

10. The system of claim 7, further comprising a driving plate engageable with the tamper head to prevent soil from entering the mandrel during driving thereof to a predetermined depth.

11. The system of claim 1, wherein said mandrel upper portion and tamper head are a single unitary unit of uniform outer diameter.

12. The system of claim 1, wherein said mandrel upper portion and tamper head are two separate units connected together.

13. The system of claim 12, wherein said tamper head is of larger diameter than said upper portion.

14. A method of constructing aggregate piers comprising use of a mandrel having an upper portion and a tamper head, the upper portion and the tamper head being for allowing flow of aggregate therethrough, the method comprising:

providing a plurality of structural members connected inside the tamper head in a configuration for allowing aggregate to remain in a cavity formed by driving of the mandrel, and for allowing substantially unimpeded free flow of aggregate through the tamper head when the mandrel is raised during operation; and preventing aggregate flow back into the mandrel during tamping operations through engagement between said structural members and said aggregate.

15. The method of claim 14, further comprising feeding aggregate into said tamper head and driving the mandrel to a desired depth.

16. The method of claim 15, further comprising feeding aggregate into the mandrel when the mandrel is at the desired depth, raising the mandrel to allow said aggregate to remain, tamping the discharged aggregate and repeating said steps until a desired aggregate pier is built.

17. The method of claim 16, wherein said aggregate is one of stone, recycled concrete, recycled asphalt, slag, sand, and glass.

18. The method of claim 14, further comprising engaging a sacrificial plate with the tamper head to close flow into the tamping head, and driving the mandrel to a desired depth.

19. The method of claim 18, wherein said sacrificial plate is released from the tamper head upon driving to said desired depth.

20. The method of claim 19, further comprising feeding aggregate into the mandrel when the mandrel is at the desired depth, raising the mandrel to allow said aggregate to remain, tamping the discharged aggregate and repeating said steps until a desired aggregate pier is built.

21. The method of claim 20, wherein said aggregate is one of stone, recycled concrete, recycled asphalt, slag, sand, and glass.

22. The method of claim 14, wherein said structural members comprise moveable mechanical flow restrictors which move to block the tamper head passage into the mandrel preventing aggregate from flowing into the mandrel during tamping.

23. The method of claim 22, wherein said mechanical flow restrictors comprise chains attached around an inner wall of the tamper head to extend downward therein.

24. The method of claim 14, wherein said structural members comprise immobile passive flow restrictors which impede flow of aggregate into the mandrel during tamping.

25. The method of claim 24, wherein said immobile passive flow restrictors are substantially horizontally extending members around an interior periphery of the tamper head.

26. The method of claim 25, wherein said substantially horizontally extending members have a top surface inclined from about 0 degrees relative to the horizontal to about 60 degrees downward from the horizontal.

27. A system for constructing aggregate piers, comprising:

a mandrel having an upper portion and a tamper head, and a passage extending therethrough for feeding aggregate through the mandrel to the tamper head; and said tamper head being open to provide a passage for aggregate to pass through the tamper head into a cavity, and having a plurality of moveable mechanical flow restrictors which allow for substantially unimpeded flow of aggregate through the tamper head when the mandrel is raised and move to block the tamper head passage into the mandrel for preventing aggregate from flowing into the mandrel during tamping.

28. The system according to claim 27, wherein said mechanical flow restrictors comprise chains attached around an inner wall of the tamper head to extend downward therein.

29. The system according to claim 27, wherein said tamper head is larger in diameter than the upper portion of the mandrel.

30. The system according to claim 27, further comprising a driving plate engageable with the tamper head to prevent soil from entering the mandrel during driving thereof to a predetermined depth.

31. A system for constructing aggregate piers, comprising:

a mandrel having an upper portion and a tamper head, and a passage extending therethrough for feeding aggregate through the mandrel to the tamper head; and said tamper head being open to provide a passage for aggregate to pass through the tamper head into a cavity, and having immobile passive flow restrictors for allowing substantially unimpeded flow of aggregate through the tamper head when the mandrel is raised and for preventing aggregate from flowing into the mandrel during tamping.

32. The system according to claim 31, wherein said immobile passive flow restrictors are substantially horizontally extending members fixed around an inner wall of the tamper head around an interior periphery thereof.

33. The system according to claim 32, wherein said substantially horizontally extending members have a top surface inclined from about 0 degrees relative to the horizontal to about 60 degrees downward from the horizontal.

34. The system according to claim 31, further comprising a driving plate engageable with the tamper head to prevent soil from entering the mandrel during driving to a predetermined depth.

35. A system for constructing aggregate piers, comprising:

a mandrel having an upper portion and a tamper head, and a passage extending therethrough for feeding aggregate through the mandrel to the tamper head; and said tamper head being open to provide a passage for aggregate to pass through the tamper head out of the mandrel, and having a plurality of moveable mechanical flow restrictors connected therein for allowing substantially unimpeded free flow of aggregate therethrough when the mandrel is raised during operation, and for preventing aggregate flow back into the mandrel during tamping.

36. A method of constructing aggregate piers, comprising use of a mandrel having an upper portion and a tamper head, the upper portion and the tamper head being for allowing flow of aggregate therethrough, the method comprising:

providing a plurality of moveable mechanical flow restrictors connected inside the tamper head in a configuration for allowing aggregate to remain in a cavity formed by driving of the mandrel, and for allowing substantially unimpeded free flow of aggregate through the tamper head when the mandrel is raised during operations; and preventing aggregate flow back into the mandrel during tampering operations through engagement between said moveable mechanical flow restrictors and said aggregate.

* * * * *